US006379018B1

(12) United States Patent
Rycroft et al.

(10) Patent No.: US 6,379,018 B1
(45) Date of Patent: Apr. 30, 2002

(54) PORTABLE ILLUMINATED DRINKING VESSEL ASSEMBLY

(76) Inventors: Kendall Rycroft, 2203 Banyan Dr., Navarre, FL (US) 32566; Everett B. James, Jr., 2206 W. 11th St., Panama City, FL (US) 32401

( * ) Notice: Subject to any disclaimer, the term of this patent is extended or adjusted under 35 U.S.C. 154(b) by 0 days.

(21) Appl. No.: 09/662,612

(22) Filed: Sep. 15, 2000

(51) Int. Cl.[7] ..... F21V 33/00
(52) U.S. Cl. ..... 362/101; 362/562; 362/565
(58) Field of Search ..... 362/562, 565, 362/101, 35, 293, 551, 581; 385/31, 901

(56) References Cited

U.S. PATENT DOCUMENTS 3,735,113 A * 5/1973 Stott ..... 240/6.4
6,158,870 A * 12/2000 Ramirez ..... 362/101
6,186,637 B1 * 2/2001 Murrietta ..... 362/101

* cited by examiner

*Primary Examiner*—Sandra O'Shea
*Assistant Examiner*—John Anthony Ward
(74) *Attorney, Agent, or Firm*—William B. Noll

(57) ABSTRACT

A portable, illuminated, drinking vessel assembly for receiving a variety of sizes of liquid containing drinking vessels, such as an infant's bottle. The assembly comprises a generally circular, vessel receiving housing formed of a lightweight material, such as may be molded of a semi-rigid foam. The housing includes a base having a central cavity mounting a light and power source. Further, the housing includes an upstanding circular side wall terminating in an annular surface to define a vessel receiving recess. Within the wall are plural radially and upwardly extending, light transmitting, fiber optic filament segments. The respective segments extend from positions in close proximity to the light to the annular surface. By the use of a movable wheel, having different color filters, between the light and the respective filament segments, movement of the wheel effects a changing color light pattern about the annular surface.

7 Claims, 4 Drawing Sheets

PORTABLE ILLUMINATED DRINKING VESSEL ASSEMBLY

RELATED APPLICATION

This application is related to co-pending application, Ser. No. 09/382,766, filed Aug. 25, 1999, under the title "Drinking Vessel Light", by one of the inventors hereof, where the contents thereof are incorporated herein by reference.

FIELD OF THE INVENTION

The present invention is directed to the field of portable, light weight lighting devices for drinking vessels, more particularly to a device for receiving an infant bottle or small child's drinking cup, where the light has a simulated movement to focus the child's attention and distract him/her from surrounding activities.

BACKGROUND OF THE INVENTION

This invention relates to a portable and light weight illuminated drinking vessel assembly, such as might be used to receive and hold a baby's bottle or drinking cup. The assembly, preferably molded in large part of a light weight, semi-rigid foam, means that it can be readily handled by a small infant or child, then washed by conventional means to sanitize same for the next use.

Feeding a baby his/her bottle can sometimes be a tricky task. The baby may be fidgety or cranky, making it difficult for an adult to keep the baby's attention on feeding itself from the bottle. Many a parent can relate to trying to stimulate or otherwise entertain the baby during the feeding task in order to assure operational success.

The problem then becomes how to entertain the infant while focusing his/her attention on the task at hand. Additionally, the infant can be distracted by siblings or pets in the vicinity of the feeding operation. Most amateur parental entertainers can only keep the baby's attention a relatively short time, which time is not sufficiently long to accomplish the task at hand.

Many babies are quite fascinated by lights and there are many objects that are designed to entertain a baby that utilize light as a stimulant. A problem with such devices is that with one hand holding the baby and the other hand holding the bottle, the parent is at a hand capacity disadvantage. Light stimulation devices, as attention getting devices, have been used with adult drinking vessels. Examples of exemplary lighted adult devices, such as by the use of chemilluminscent materials, may be found in the following U.S. Pat. Nos.:

No. 6,082,866, to Amedee; No. 5,709,449, to Kuo; No. 5,695,270, to Collet; No. 5,624,177, to Rosaia; No. 5,171,081, to Pita et al.; No. 5,056,749, to Saotome; and No. 4,336,574, to Goodman.

None of these prior art devices provide a convenient means to use same with an infant's bottle or drinking cup, much less offer the needed distraction from surrounding activities that a parent requires. Accordingly, there is a need for a device that provides a light that is capable of positively stimulating an infant and focus his/her attention during the feeding process. Such device must be effectively utilizable by a parent that otherwise has both hands when feeding the infant. Preferably, the device will be of relatively simple design and construction, easy to use, non-disposable, and washable. The manner by which the present drinking vessel assembly meets and surpasses these goals will become more apparent in the description which follows, particularly when read in conjunction with the accompanying drawings.

SUMMARY OF THE INVENTION

This invention is directed to a portable, illuminated, drinking vessel assembly for receiving a liquid containing drinking vessel, such as a baby's bottle or drinking cup. The assembly comprises a generally circular vessel receiving housing formed of a light-weight, semi-rigid material, such as a molded foam. The housing is characterized by a base having a central cavity mounting an electrical light and supporting power source, i.e. battery, and a circular side wall extending from the base and terminating in an annular surface to define a vessel receiving recess. Additionally, there is included a series of spaced apart radially and upwardly extending, light transmitting, fiber optic filament segments within the sidewall. The segments are arranged such that a first end of each segment is in close proximity to the light source, and the opposite end of each segment terminates along the annular surface. By the incorporation of a rotating wheel, having radial segments of different opaque color segments, where the wheel preferably includes a separate power source and motor. The wheel is positioned intermediate the light source and the respective first ends. With the rotation of the wheel, whether continuous or back and forth, the assembly has the effect of changing lights. It will be appreciated that as the infant drinks from his/her bottle, the changing light through the respective fiber optic segments will be a focal point for the infant's attention, thus making the feeding process a more pleasant experience for the infant and parent. Additionally, the drinking vessel assembly may include a second recess, extending downwardly and concentricly with the vessel receiving recess for removably receiving a silver coated, concave reflector member, and lens, where the lens may include indicia or a design to project an image on a remote surface.

Accordingly, an object of this invention is to provide a convenient and entertaining device to facilitate feeding of an infant.

Another object hereof is the provision of an attention focusing means for an infant during the feeding process.

A further object of the invention lies in the use of a light-weight, semi-rigid, molded foam to render it easy for an infant or young child to hold the bottle receiving assembly hereof.

Still another object of the invention lies in the use of fiber optic filament segments as a means to transmit an eye focusing light pattern to the infant using the bottle receiving assembly.

These and other objects will become more apparent in the description which follows, particularly when read by those skilled in the art.

DETAILED DESCRIPTION OF PREFERRED EMBODIMENT

Figure 1:
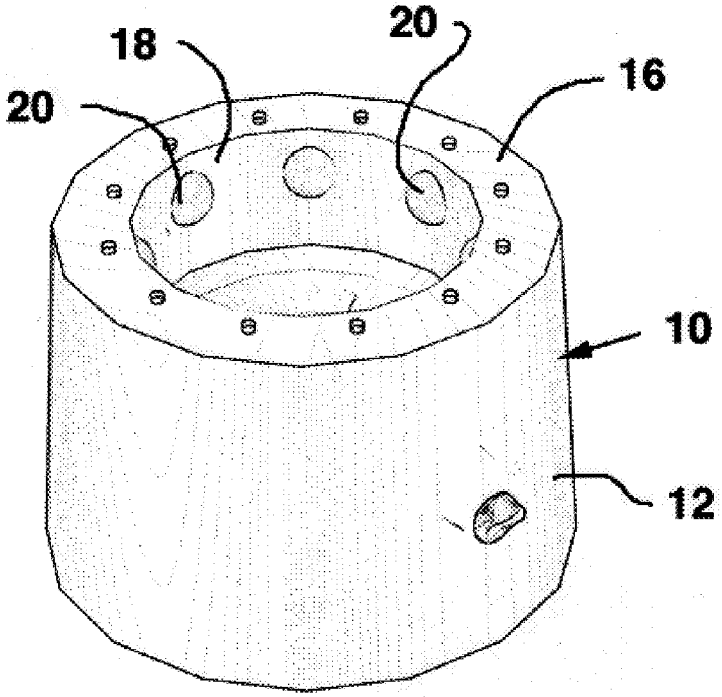
FIG. 1 is a top perspective view of the portable illuminated drinking vessel assembly of this invention.

The present invention, in its preferred embodiment, relates to a portable, illuminated, drinking vessel assembly, particularly as a convenient means to receive a baby's bottle for use in feeding the baby. The assembly hereof incorporates a unique lighting system, by the use of plural fiber optic filament segments, that can function as a source of entertainment for the feeding infant through changing colors. The vessel drinking assembly hereof will now be described with regard to the accompanying Figures, where like reference numerals represent like components or features throughout the several views.

Figure 2:
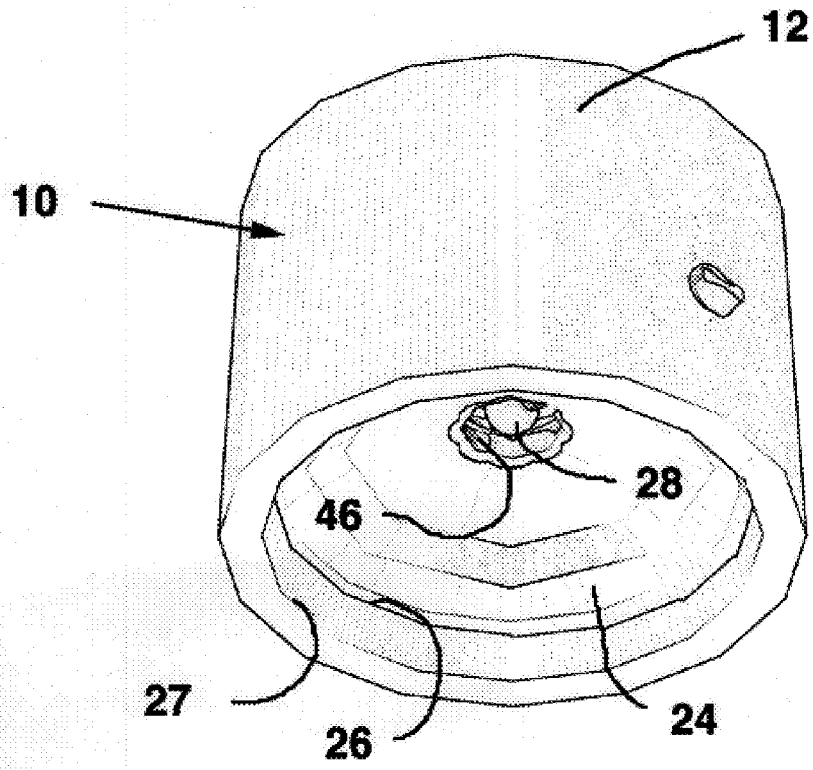
FIG. 2 is a bottom perspective view of the assembly hereof.

Turning now to the several Figures, FIGS. 1 and 2, respectively, illustrate top and bottom perspective views of the vessel receiving housing 10 of the portable illuminated drinking vessel assembly of this invention, where the housing is particularly adapted to receive a baby's bottle. Although other drinking vessels or cups may be received therein, for convenience in understanding the invention, the further description will be directed to its use for a baby's bottle. The housing 10, preferably formed of a semi-rigid material, such as a foam, the housing includes a continuous sidewall 12 terminating in an annular surface 16 to define an upper bottle receiving recess 18, where the recess 18 includes a series of compressible nipples 20, along the recess wall 22, to snugly receive and hold a baby's bottle. The bottom includes a second recess 24, having a pair of annular grooves 26, 27, the function of which will become clearer hereafter, that is concentric to the recess 18.

Figure 3:
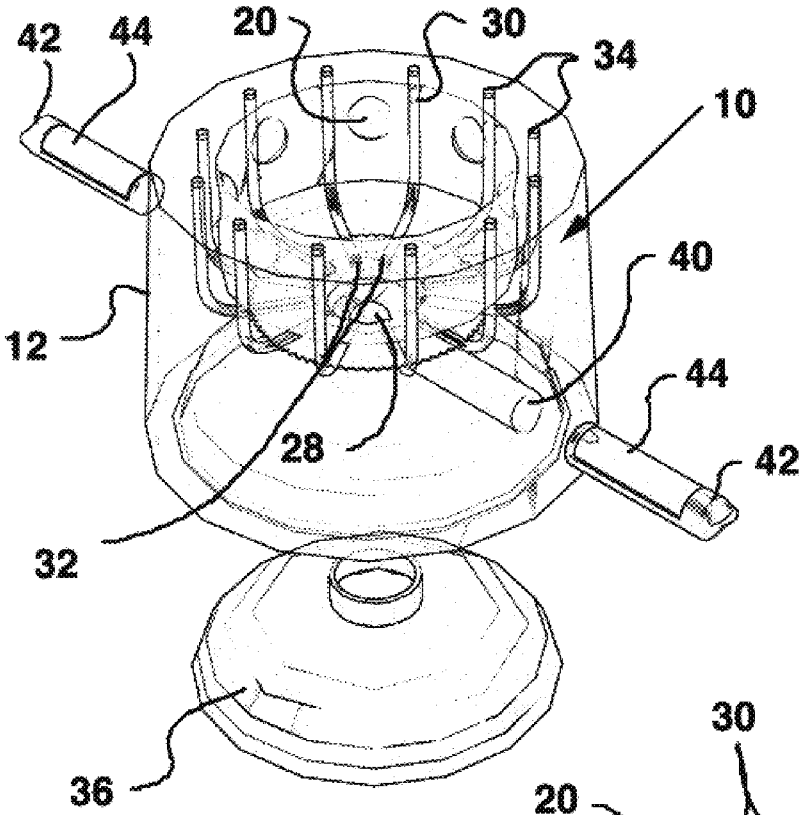
FIG. 3 is an exploded perspective, with parts in phantom, to show internal details, a pair of battery packs or casements poised for entry into the assembly housing, and a reflector plate.

As best seen in FIG. 3, the respective recesses 18, 24 are joined by a concentric, axially elongated opening 28. The housing 10 further features a plurality of radially and downwardly extending, light transmitting, fiber optic segments 30 within the sidewall 12, where the first ends 32 thereof open in proximity to the intersection between the upper recess 18 and the opening 28, with the opposite ends 34 extending to at least the annular surface 16. If desired, the opposite ends of the respective segments 30 may extend slightly above the surface 16.

Shown below the housing 10 is a circular, concave reflector member 36, preferably with a reflective coating on the inner surface 38 (FIG. 4), that is sized to snap fit into the first annular groove 26. The housing 10 further features a pair of aligned lateral channels 40 for slidably receiving a battery pack, or casement 42, 42' which inturn receive removable batteries 44, 44'. As more clearer illustrated in FIG. 4, battery 44 is intended to power a light source, or bulb 46, while battery 44' is intended to power a small motor 48, the function of which will be described later.

Figure 4:
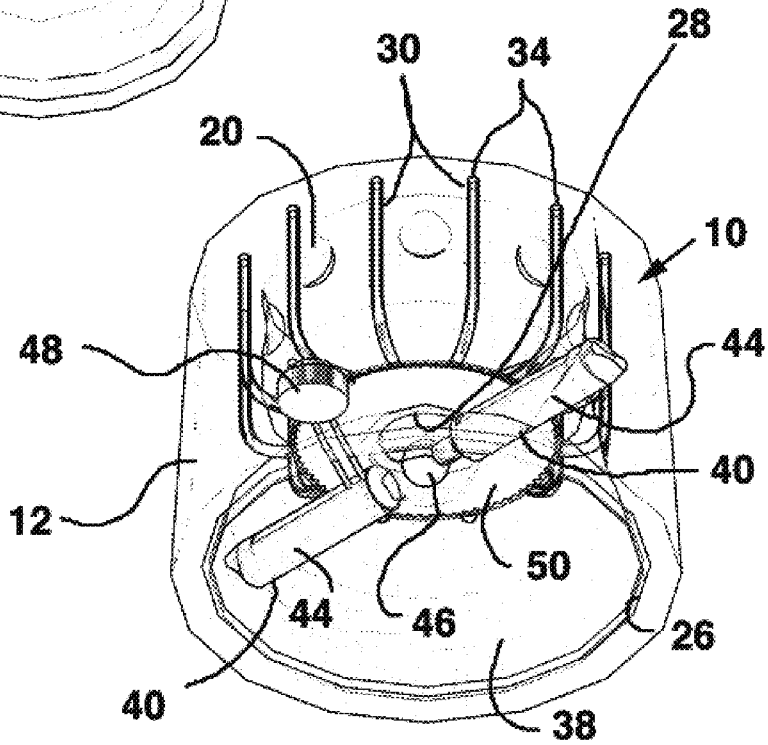
FIG. 4 is a bottom perspective view, with parts in phantom, showing different internal details of the assembly of the invention.
Figure 5:
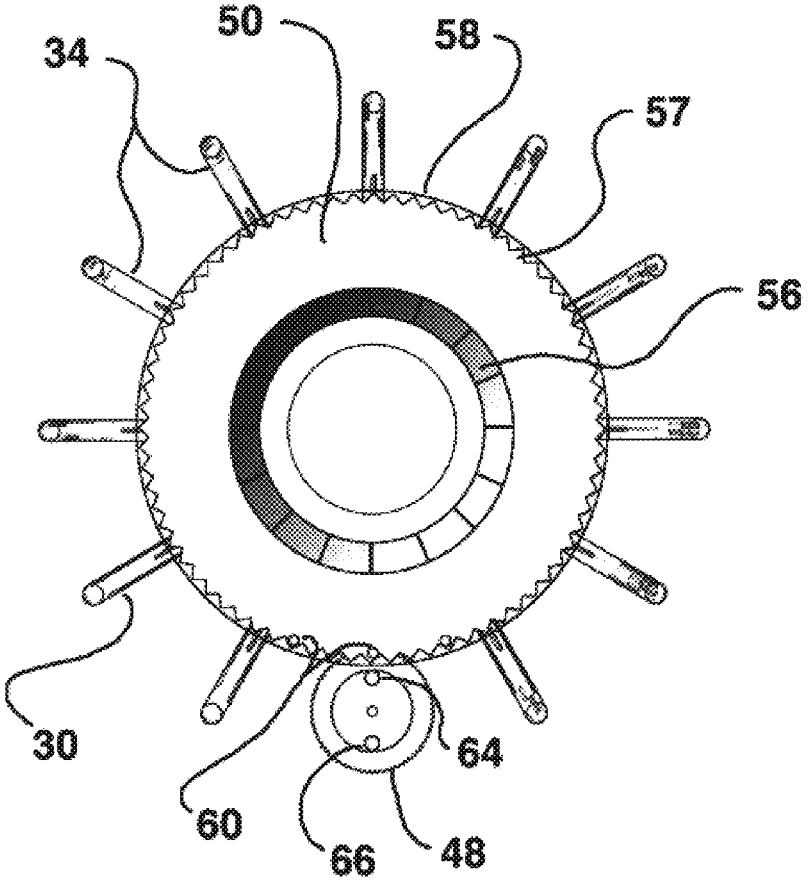
FIG. 5 is an enlarged top view showing the motor for driving a color transmitting wheel of the invention.
Figure 6:
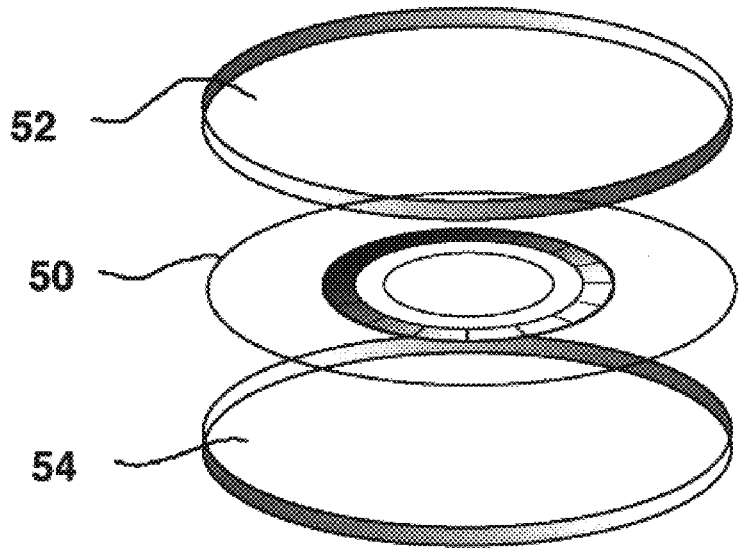
FIG. 6 is an exploded perspective view showing an encasement assembly for the color transmitting wheel for use in the invention hereof.

Since a feature of the invention is to provide changing colors that pass through the respective segments 30, means have been provided by a movable wheel 50, see FIGS. 4–6. The movable wheel is preferably encased in a sealed, liquid environment by transparent, engaging encasement members 52, 54, see FIG. 6. As best seen in FIG. 5, the movable wheel features a continuous, opaque color segments 56, where the respective colors are selected from those of a rainbow, for example. That is, as the wheel 50 moves relative to the fiber optic segments 30, where the wheel is positioned in proximity to the segment ends 32, light from the bulb 46 is filtered by the different colors. Returning to the wheel construction, the periphery 57 thereof preferably is saw-toothed 58 to minimize rotating contact within the joined encasement members 52, 54. Additionally, in close proximity to the periphery 57, a series of magnets 60, with alternating polarity, are provided, see FIG. 5. To power the wheel 50, a small motor 48, featuring a pair of opposite poled magnets 64(+) and 66(–), is positioned adjacent the wheel 50. In a non-moving mode, the magnet on the wheel is opposite in polarity to that of the motor magnet. However, as the motor 48 begins to rotate, the polarity of the motor magnet will repel the same polar magnet of the wheel causing the wheel 50 to move. Whether the wheel moves back and forth, or incrementally in a single direction, different colored lights will be transmitted through the respective fiber optic segments 30.

Figure 7:
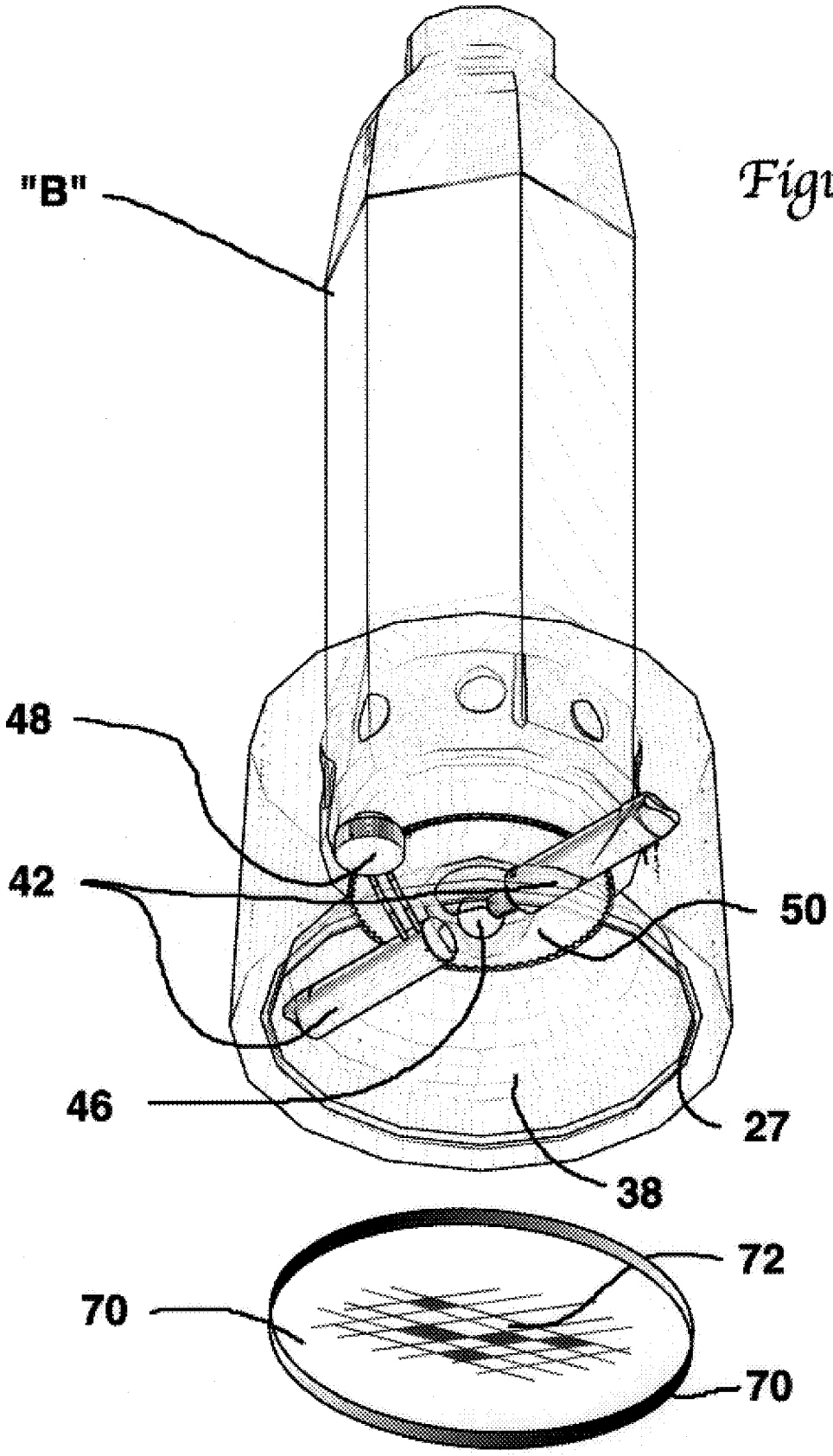
FIG. 7 is a bottom perspective view, with parts shown in phantom, further illustrating a baby's bottle positioned within the assembly of this invention.

FIG. 7 illustrates an exemplary use for the drinking vessel assembly of this invention by the inclusion of a baby's bottle (B). It will be appreciated that with the light weight of the assembly, it will be quite easy for a young child to hold the bottle and assembly when feeding. Since operation of the assembly is only desired when an infant may be drinking from same, a convenient means is provided to turn the assembly on and off. A preferred means is to apply an axial pressure to the respective battery encasement 42, 42' to activate the bulb 46 and motor 48. The lighted bulb 46 forms a dual purpose. Shown below the housing 10 in FIG. 7 is a lens 70 to be positioned in the lower annular groove 27. The lens may be provided with indicia or design 72, such that when the bulb is lit an image of the indicia or design can be projected onto a surface, such as a wall or table top.

It is recognized that variations, modifications and changes may be made to the assembly and construction of the invention, particularly by those skilled in the art, without departing from the spirit and scope thereof, such as for example the substitution of a coiled spring to power the wheel 50. Accordingly, no limitation is intended to be imposed thereon except as set forth in the accompanying claims.

What is claimed is:

1. A portable illuminated drinking vessel assembly for receiving a liquid containing drinking vessel, said assembly comprising a generally circular, vessel receiving housing formed of a light-weight, semi-rigid material, said housing including a base having a central cavity mounting an electrical light source and supporting electrical power source, a circular side wall extending from said base and terminating in an annular surface to define a vessel receiving recess, and plural radially and upwardly extending, light transmitting, fiber optic filaments segments within said sidewall, where a first end of each said segment is in close proximity to said light source, and the opposite end of each said segment terminates along said annular surface.

2. The portable illuminated drinking vessel assembly according to claim 1, wherein said light-weight material is a flexible molded foam.

3. The portable illuminated drinking vessel assembly according to claim 2, further including a moving wheel, with means to effect movement thereof, intermediate said light source and said first ends, where movement of said wheel effects a changing of the light emanating from said segments about said annular surface.

4. The portable illuminated drinking vessel assembly according to claim 2, wherein said vessel receiving recess includes an essentially vertical wall having a series of spaced apart compression nodules in close proximity to said annular surface, whereby a variety of vessel sizes may be snugly held therewithin.

5. The portable illuminated drinking vessel assembly according to claim 1, wherein said housing includes a second recess opening to the bottom of said housing, and mounted within said second recess is a concave reflector member.

6. The portable illuminated drinking vessel assembly according to claim 5, wherein said second recess further mounts a lens bearing selected indicia or design that may be imaged upon a remote surface.

7. The portable illuminated drinking vessel assembly according to claim 3, wherein said movement means comprises said motor having a pair of opposite polarity magnets, and said moving wheel having a periphery of magnets of alternating polarity.

* * * * *